US010155375B2

(12) United States Patent
Vella

(10) Patent No.: US 10,155,375 B2
(45) Date of Patent: Dec. 18, 2018

(54) MANDREL FOR PRINTING NECKED CANS

(71) Applicant: Stolle Machinery Company, LLC, Centennial, CO (US)

(72) Inventor: Anthony Joseph Vella, Aurora, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 12 days.

(21) Appl. No.: 15/381,165

(22) Filed: Dec. 16, 2016

(65) Prior Publication Data

US 2018/0170031 A1 Jun. 21, 2018

(51) Int. Cl.

| | |
|---|---|
| ***B41F 3/54*** | (2006.01) |
| ***B41F 17/22*** | (2006.01) |
| ***B41F 17/30*** | (2006.01) |
| ***B41F 17/00*** | (2006.01) |
| ***B41F 17/28*** | (2006.01) |
| ***B41F 17/18*** | (2006.01) |

(52) U.S. Cl.

CPC ..... *B41F 17/22* (2013.01); *B41F 3/54* (2013.01); *B41F 17/002* (2013.01); *B41F 17/006* (2013.01); *B41F 17/18* (2013.01); *B41F 17/28* (2013.01); *B41F 17/30* (2013.01); *B41P 2227/00* (2013.01); *B41P 2227/10* (2013.01); *B41P 2227/60* (2013.01)

(58) Field of Classification Search

CPC ..... B41F 17/002; B41F 17/006; B41F 17/18; B41F 17/22; B41F 17/28; B41F 17/30; B41F 3/54; B41J 3/4073; B41P 2227/00; B41P 2227/10; B41P 2227/20; B41P 2227/21; B41P 2227/60

See application file for complete search history.

(56) References Cited

U.S. PATENT DOCUMENTS

| | | | | |
|---|---|---|---|---|
| 4,140,053 A * | 2/1979 | Skrypek | ..... | B41F 17/22 101/247 |
| 4,267,771 A * | 5/1981 | Stirbis | ..... | B41F 17/22 101/40 |
| 4,821,638 A * | 4/1989 | Uithoven | ..... | B41F 17/14 101/40 |

(Continued)

FOREIGN PATENT DOCUMENTS

| | | | | |
|---|---|---|---|---|
| JP | 60094355 | * | 5/1985 | ..... B41F 17/28 |

*Primary Examiner* — Leslie J Evanisko
*Assistant Examiner* — Marissa Ferguson Samreth
(74) *Attorney, Agent, or Firm* — Eckert Seamans Cherin & Mellott, LLC

(57) ABSTRACT

A mandrel wherein a portion of the mandrel body outer surface is cortical; i.e., flared outwardly, is provided. In this configuration, the necked can is drawn against the conical portion of the mandrel body outer surface while a generally cylindrical portion of the mandrel body extends into the can. Further, the space between the cylindrical portion of the mandrel body and the can is pressurized so as to resist deformations in the can during the decorating process. In an exemplary embodiment, the mandrel includes an elongated mandrel body with an outer surface, a proximal, first end, a proximal medial portion, a distal medial portion, and a distal, second end and having an axis of rotation. The mandrel body outer surface includes an elongated conical portion; the mandrel body outer surface conical portion is disposed adjacently about the mandrel body first end.

3 Claims, 3 Drawing Sheets

(56) References Cited

U.S. PATENT DOCUMENTS

| | | | | | |
|---|---|---|---|---|---|
| 4,846,483 | A * | 7/1989 | Sorensen | B41F 17/28 | 101/40 |
| 4,926,788 | A * | 5/1990 | Metcalf | B05C 13/025 | 118/46 |
| 5,207,156 | A * | 5/1993 | Helling | B41F 15/30 | 101/126 |
| 5,232,328 | A * | 8/1993 | Owczarz | H01L 21/67028 | 414/590 |
| 5,716,078 | A * | 2/1998 | Powers | F16L 15/008 | 285/110 |
| 5,799,574 | A * | 9/1998 | Williams | B41F 17/22 | 101/38.1 |
| 6,148,725 | A * | 11/2000 | Knauer | B41N 6/00 | 101/217 |
| 6,167,805 | B1 | 1/2001 | Williams et al. | | |
| 6,467,609 | B1 | 10/2002 | Williams et al. | | |
| 6,651,552 | B1 * | 11/2003 | Didonato | B41F 17/22 | 101/247 |
| 6,840,166 | B2 * | 1/2005 | Jeter | B41F 17/002 | 101/247 |
| 9,327,493 | B1 | 5/2016 | Vella | | |
| 2007/0125248 | A1 * | 6/2007 | Coyle | B29C 43/46 | 101/216 |
| 2012/0213461 | A1 * | 8/2012 | Fleischer | B41F 17/002 | 384/490 |

* cited by examiner

MANDREL FOR PRINTING NECKED CANS

BACKGROUND OF THE INVENTION

Field of the Invention

The disclosed concept relates generally to machinery and, more particularly, to can decorator machines for decorating cans used in the food and beverage packaging industries. The disclosed concept also relates to mandrels and mandrel assemblies structured to support necked cans.

Background Information

High speed continuous motion machines for decorating cans, commonly referred to as can decorator machines or simply can decorators, are generally well known. A typical can decorator is disclosed in commonly assigned U.S. Pat. No. 5,337,659. It is understood that during the decorating process, the cans are "can bodies," i.e., shells having a substantially cylindrical body with one closed end and one open end or, in some instances, two open ends. The can decorator includes an in-feed conveyor, which receives cans from a can supply (not shown) and directs them to arcuate cradles or pockets along the periphery of spaced parallel rings secured to a pocket wheel. The pocket wheel is fixedly secured to a continuously rotating mandrel carrier wheel or turret. The turret, in turn, is keyed to a continuously rotating horizontal drive shaft. Radial/horizontal spindles or mandrels, each being rotatable about its own axis, are mounted to the mandrel carrier wheel adjacent its periphery. Downstream from the in-feed conveyor, each mandrel is in closely spaced axial alignment with an individual pocket and undecorated cans are transferred from the pockets to the mandrels. Suction applied through an axial passage of the mandrel draws the can to a final seated position on the mandrel.

While mounted on, and rotating with, the mandrels, the cans are decorated by inking stations such as, but not limited to, inking stations including blankets or digital print heads. That is, the inking station(s) applies ink in a selected pattern while mandrels rotate the cans. Thereafter, and while still mounted on the mandrels, the outside of each decorated can is coated with a protective film of varnish applied by engagement with the periphery of an application roll in an over-varnish unit or digital print heads. Cans with decorations and protective coatings thereon are then transferred from the can decorator for further processing.

Generally, the can bodies and the mandrels are substantially cylindrical. The can bodies have a cross-sectional area that is slightly larger than the mandrel. In this manner, the can fits over the mandrel with the suction applied to the closed end of the can. It is noted that the open end of the can generally does not engage the mandrel. Such mandrels, however, are not structured to decorate can bodies that have been "necked." That is, a "necked" can has been formed so that the end of the can about the open end has a smaller cross-sectional area relative to most other portions of the can. In this configuration, a cylindrical mandrel sized to pass through the necked open end of the can has a smaller cross-sectional area relative to most other portions of the can. In this configuration, the can is likely to wobble on the mandrel during the decorating process. This is a problem.

SUMMARY OF THE INVENTION

The disclosed and claimed concept provides a mandrel wherein a portion of the mandrel body outer surface is conical; i.e., flared outwardly. In this configuration, the can is drawn against the conical portion of the mandrel body outer surface while a generally cylindrical portion of the mandrel body extends into the can. Further, the space between the cylindrical portion of the mandrel body and the can is pressurized so as to resist deformations in the can during the decorating process. In an exemplary embodiment, the mandrel includes an elongated mandrel body with an outer surface, a proximal, first end, a proximal medial portion, a distal medial portion, and a distal, second end and having an axis of rotation. The mandrel body outer surface includes an elongated conical portion; the mandrel body outer surface conical portion is disposed adjacently about the mandrel body first end. The disclosed and claimed mandrel configuration solves the problem stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
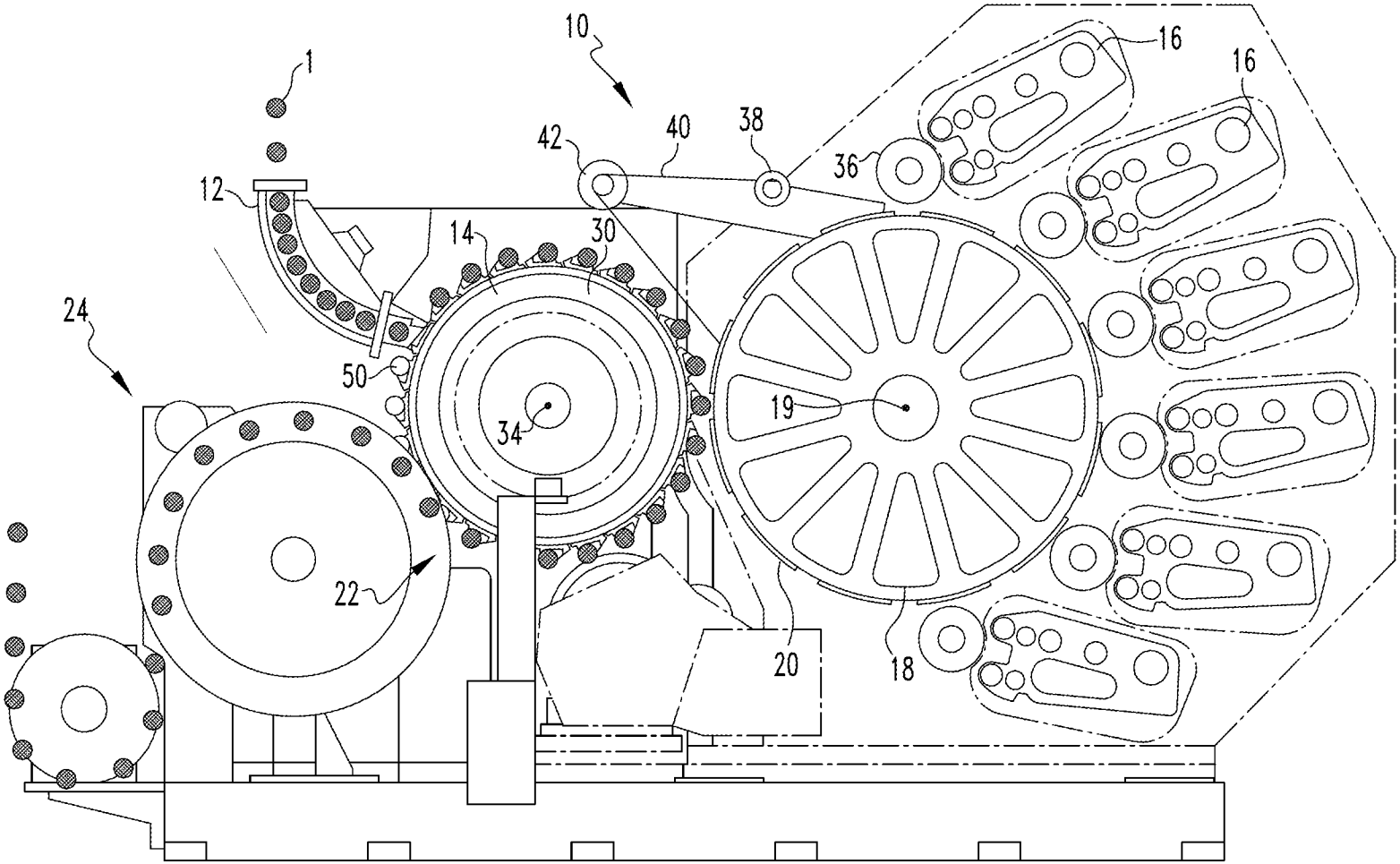
FIG. 1 is a side view of a can decorator.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise. As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, a "path of travel" or "path," when used in association with an element that moves, includes the space an element moves through when in motion. As such, any element that moves inherently has a "path of travel" or "path."

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engage" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans. As used herein, a "necked can" is a can including a sidewall and one open end wherein the open end has a cross-sectional area that is less than the cross-sectional area of the other portions of the sidewall. It is noted that a can wherein a closed end of the can has a cross-sectional area that is less than the cross-sectional area of the other portions of the sidewall is not determinative of whether the can is a "necked can." That is, the cross-sectional area of a closed can end is not relevant to that nature of a can as a "necked can."

As used herein, "generally curvilinear" includes elements having multiple curved portions, combinations of curved portions and planar portions, and a plurality of planar portions or segments disposed at angles relative to each other thereby forming a curve.

As used herein, a "contour" means the line or surface that defines an object. That is, for example, when viewed in cross-section, the surface of a three-dimensional object is reduced to two-dimensions; thus, a portion of a three-dimensional surface contour is represented by a two-dimensional line "contour."

As used herein, a "perimeter portion" means the area at the outer edge of a defined area, surface, or contour.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and near relevant to the term being modified as would be understood by one of ordinary skill in the art.

An exemplary can decorator 10 for a can 1 is shown in FIG. 1. It is understood that can decorators which use mandrels may be in other configurations such as, but not limited to, the can decorator disclosed in U.S. Pat. No. 9,327,493. Further, as described below, the can 1 is assumed to be substantially circular. It is understood, however, that the can 1 and elements that interact with the can 1, may have a shape other than substantially circular. Further, the can 1 is a "necked" can 1 as described above; that is, the can 1 has a sidewall 2 with a first cross-sectional area, a necked opening 3 with a smaller, second cross-sectional area, and a closed end 4 which, in an exemplary embodiment, is domed.

The can decorator 10 includes a can infeed 12, a mandrel turret 14, a plurality of ink stations 16, a blanket wheel 18 having a plurality of blankets 20 disposed about the outer circumference, and a can transfer assembly 22. Generally, the configuration of the mandrel turret 14 is not relevant to the present concept, but it is noted that the mandrel turret 14 includes a drive assembly 50 structured, to rotate each mandrel assembly 50 and/or mandrel 80, discussed below.

Generally, each mandrel assembly includes a mandrel shaft body 62 and a mandrel 80 disposed thereabout. The mandrel shaft body 62 and mandrel 80 are discussed in detail below. A number, or a plurality, of mandrel assemblies 50 are coupled to the mandrel turret 14. The mandrel assemblies 50 are generally elongated and coupled at one end to the mandrel turret 14. In the embodiment shown, each mandrel assembly 50, and more specifically each mandrel shaft body 62 extends substantially parallel to the mandrel turret 14 axis of rotation 34. It is noted that in other embodiment, such as the embodiment shown in U.S. Pat. No. 9,327,493, each mandrel assembly 50 extends generally radially relative to the mandrel turret 14 axis of rotation 34. In the embodiment shown, the blanket wheel 18 is also structured to rotate on an axis 19 that extends substantially parallel to the mandrel turret axis of rotation 34. The blankets 20 are disposed on the outer surface of the blanket wheel 18. Thus, the blankets 20 are positioned to laterally, or radially, engage the mandrel assemblies 50. As is known, each ink station 16 applies an ink to the blankets 20, typically via an intermediate plate cylinder 36. The ink stations 16 are disposed, generally, on the side of the blanket wheel axis of rotation 19 opposite the mandrel carrier 30. A prespin assembly 38 (shown schematically) which typically comprises a plurality of belts 40 and guide wheels 42 is operatively coupled to the blanket wheel 18 and has a belt 40 structured to engage a mandrel 80 (described below) and spin the mandrel 80.

In operation, a can 1 is disposed over the distal end of a mandrel assembly 50 at the can infeed 12. As the mandrel carrier 30 rotates, the mandrel assembly 50 with the can 1 is moved toward the blanket wheel 18. Prior to engaging the blanket 20, the prespin assembly belt 40 engages the mandrel 80 and causes the mandrel 80 to spin about the mandrel assembly longitudinal axis. As the mandrel carrier 30 continues to rotate, the mandrel assembly 50 with the can 1 is moved into engagement with an inked blanket 20, while spinning at a speed such that the can 1 rotates once during the engagement with the blanket 20. This causes the ink on the blanket 20 to be transferred to the can 1. The can transfer assembly 22 then removes the can 1 from the mandrel assembly 50 and transfers the can 1 to subsequent processing stations such as, but not limited to, a varnishing station and/or curing station 24.

Figure 3:
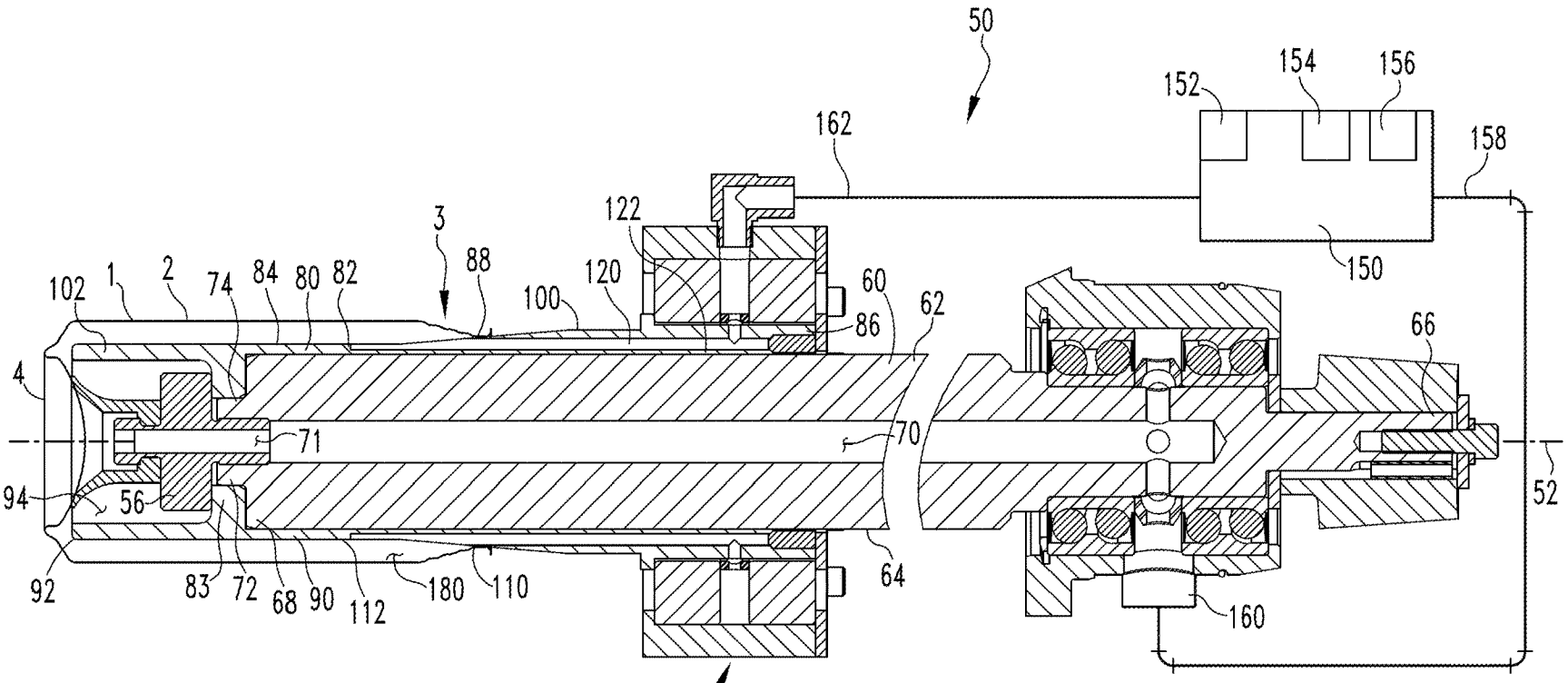
FIG. 3 is an alternate cross-sectional side view of a mandrel assembly with a necked can thereon and with a fluid system manifold.

As shown in FIG. 3, a mandrel assembly 50 includes an elongated mandrel shaft assembly 60, a mandrel 80, and a fluid system 150. Alternatively, and as used herein, the fluid system 150 is also identified as part of each mandrel shaft assembly 60 and is discussed below. Further, as the mandrel assemblies 50 are substantially similar, only one mandrel assembly 50 is described herein.

Each mandrel shaft assembly 60 includes an elongated body 62. Each mandrel shaft assembly body 62 (hereinafter "mandrel shaft body" 62) includes an outer surface 64, a proximal, first end 66, and a distal, second end 68. As used herein, an "end" of an elongated body means a length of the body at the identified "end" as opposed to just the axial face of the body. It is understood that the "proximal end" is the end coupled, or adjacent, to the mandrel turret 14. The mandrel shaft body 62 also includes a medial portion (not numbered) which further includes a proximal medial portion and a distal medial portion (neither numbered).

In an exemplary embodiment, the mandrel shaft body 62 defines a central passage which is identified herein as a vacuum conduit 70. The vacuum conduit 70 has a distal end 71 which, in an exemplary embodiment, is threaded. Further, the mandrel shaft body second end 68 includes a mounting 72. As shown and in an exemplary embodiment, the mounting 72 is a toroidal collar 74 disposed about the vacuum conduit 70 and which has a smaller cross-sectional area than the mandrel shaft body 62.

In one embodiment, the mandrel shaft body 62 is rotatably coupled to the mandrel turret 14. In another embodiment, the mandrel 80, described below, is rotatably disposed on the mandrel shaft body 62. A drive assembly (not shown) is structured to, and does, rotate the mandrel 80 or the mandrel shaft body 62 about the longitudinal axis of the mandrel shaft body 62. Thus, the mandrel assembly 50 has an axis of rotation 52 which is also the mandrel shaft body 62 axis of rotation or the mandrel 80 axis of rotation.

Each mandrel 80 includes a generally toroidal, elongated body 82. Each mandrel body 82 includes an outer surface 84, a proximal, first end 86, proximal medial portion 88, a distal medial portion 90, a distal, second end 92 and defines a generally enclosed space 94. Further, as discussed below, the mandrel body 82 rotate and, therefore, has an axis of rotation 96. It is noted that the mandrel body axis of rotation 96 is substantially aligned with the longitudinal axis of the elongated mandrel body 82. It is understood that the mandrel body proximal medial portion 88 and mandrel body distal medial portion 90 are disposed between the mandrel body first end 86 and the mandrel body second end 92 with a mandrel body midline separating the mandrel body proximal medial portion 88 and mandrel body distal medial portion 90. It is understood that the "proximal end" is the end coupled, or adjacent, to the mandrel turret 14. The mandrel body 82 is a generally toroidal body having both ends open. That is, generally, the mandrel body 82 is generally hollow and defines a passage. The mandrel body 82, in an exemplary embodiment, includes an inwardly extending, toroidal mounting flange 83. The mandrel body mounting flange 83 is structured to correspond to the mandrel shaft body mounting 72. That is, the opening defined by the mandrel body mourning flange 83 corresponds to the mandrel shaft body mounting 72.

Figure 2:
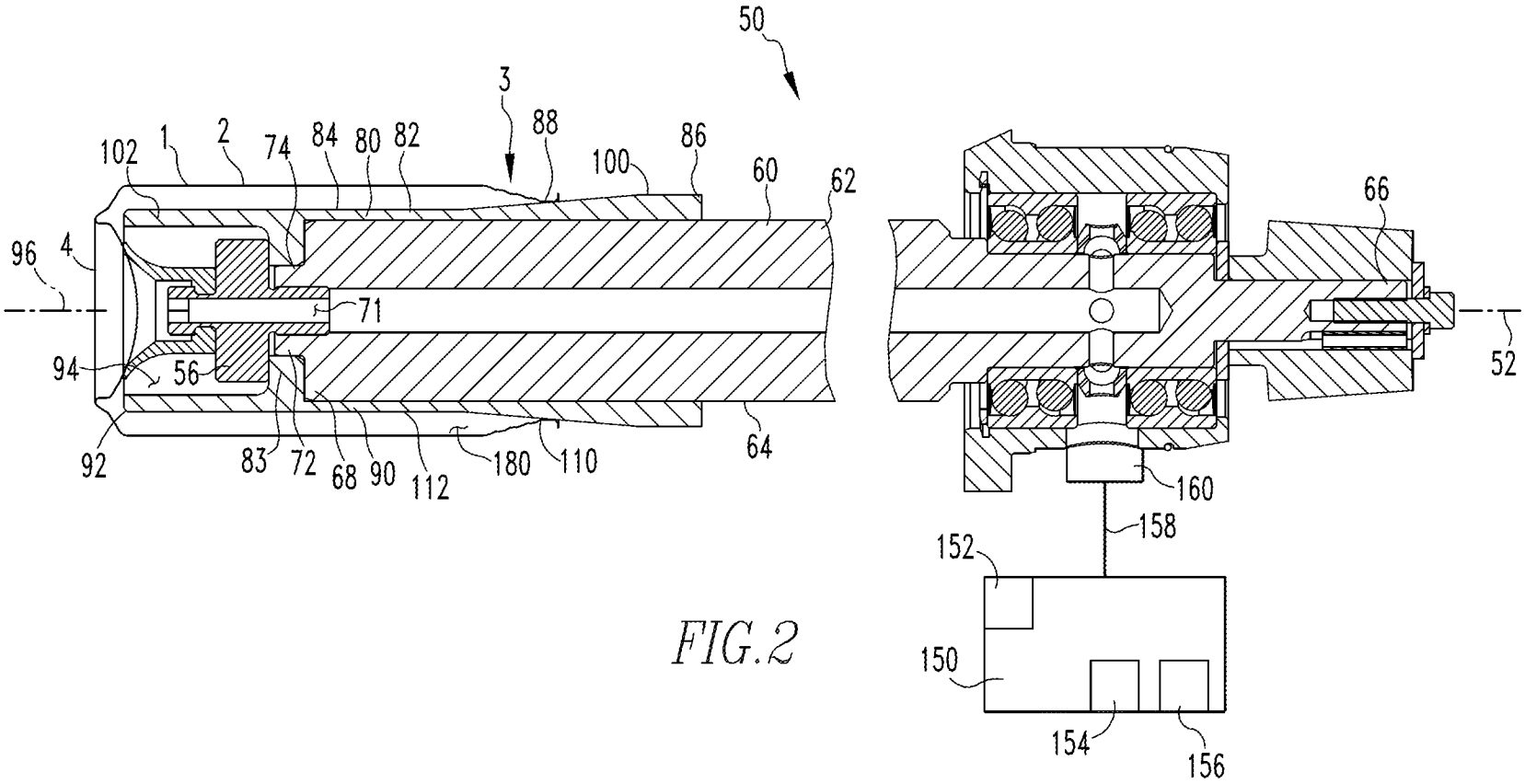
FIG. 2 is a cross-sectional side view of a mandrel assembly with a necked can thereon.

The mandrel body outer surface 84 includes an elongated conical portion 100 and an elongated generally cylindrical portion 102. As used herein, a surface with an "elongated conical portion" means a generally conical surface that has length that is more than a transition between tiers. That is, for example, U.S. Pat. No. 6,167,805 FIGS. 2 and 12 disclose tiered, tapered shafts with short conical portions between the tiers; such short conical transition portions are not, as used herein, an "elongated conical portion." In an exemplary embodiment, the mandrel body outer surface conical portion 100 is flared. As used herein, a "flared" conical portion of an elongated body having a cylindrical portion means that the wide end of the "flared" conical portion has a greater cross-sectional area than the cylindrical portion of the elongated body. In an exemplary embodiment, the mandrel body outer surface conical portion 100 is disposed adjacently about at least one of the mandrel body first end 86 and the mandrel body proximal medial portion 88. As used herein, "adjacently about" means generally encircling and near. That is, it is understood that the length of the mandrel body outer surface conical portion 100 is sized relative to the necked can being formed and the mandrel body outer surface conical portion 100; in exemplary embodiments (not shown) are disposed adjacently about one of, or a combination of, the mandrel body proximal medial portion 88, the mandrel body distal medial portion 90 and the mandrel body distal, second end 92. The mandrel body outer surface conical portion 100 defines a necked engagement surface 110. As used herein, a "necked engagement surface" is a surface that is structured to be, and is, engaged by the surface of a necked can 1. That is, a surface that is structured to be, and is, engaged by the surface of a non-necked can, or a surface that is only capable of, but is not, engaged by the surface of a necked can, is not a "necked engagement surface" as used herein.

Further, in the exemplary embodiment shown, the mandrel body outer surface cylindrical portion 102 is disposed adjacently about the mandrel body distal medial portion 90 and the mandrel body second end 92. The mandrel body outer surface cylindrical portion 102 has a cross-sectional area that is smaller than the cross-sectional area of the can necked opening 3 and the can sidewall 2. The mandrel body outer surface cylindrical portion 102 defines a non-engagement surface 112. As used herein, a "non-engagement surface" means a surface that is structured so that a can 1 does not engage the surface. For example, as shown, a surface having a cross-sectional area that is substantially smaller than the cross-sectional area of the can sidewall 2 is a "non-engagement surface." It is noted that as prior art cans are disposed over prior art mandrels, the mandrels must have a cross-sectional area that is smaller than the mandrel. The sidewalls of such prior art cans extend substantially parallel to the surface of the mandrels. Such prior art cans, however, have a cross-sectional area that is substantially similar, but slightly larger, than the prior art mandrels. Such prior art mandrels do not have, as used herein, a cross-sectional area that is "substantially smaller" than the prior art cans.

Each mandrel body 82 is disposed over and coupled, directly coupled, or rotatably coupled to an associated mandrel shaft body 62. Stated alternately, each mandrel shaft body 62 is partially disposed in an associated mandrel body enclosed space 94. Thus, each mandrel body 82 is structured to, and does, rotate about the mandrel assembly axis of rotation 52. As shown, the mandrel assembly 50 also includes a mandrel retainer 56 which is a toroidal body including a wide portion and a narrow portion (neither numbered.) The mandrel retainer 56 narrow portion is threaded and sized to correspond to the threaded vacuum conduit distal end 71. Thus, in an exemplary embodiment, the mandrel body 82 is disposed over the mandrel shaft body 62 with the mandrel body mounting flange 83 disposed on the mandrel shaft body mounting 72. The mandrel retainer 56 is then threadably coupled to the threaded vacuum conduit distal end 71. In this configuration, the mandrel body 82 is fixed to the mandrel shaft body 62. It is understood that in this configuration, the mandrel shaft body 62 rotates relative to the mandrel turret 14. Further, it is noted that the vacuum conduit 70 is in fluid communication with the passage defined by the mandrel retainer 56.

Further, in an exemplary embodiment, the mandrel body 82 defines a number of pressure conduits 120. Each pressure conduit 120 includes an inlet 122 and an outlet 124. In an exemplary embodiment, each pressure conduit inlet 122 is disposed at the mandrel body first end 86 and each pressure conduit outlet 124 is disposed adjacent the mandrel body outer surface non-engagement surface 112.

In an exemplary embodiment, the mandrel assembly 50, or as noted above, each mandrel shaft assembly 60, includes a fluid system 150, shown schematically. The fluid system 150 is includes a control assembly 152, a negative pressure generator 154, a positive pressure generator 156, a number of vacuum conduits 158, a number of vacuum couplings 160, and a number of pressure conduits 162. In an exemplary embodiment, the fluid system 150 also includes a number of manifolds 164. The negative pressure generator 154 is structured to, and does, generate a negative pressure in a fluid relative to the atmospheric pressure and which, as used herein, is identified as a "vacuum." The positive pressure generator 156 is structured to, and does, generate a positive pressure in a fluid relative to the atmospheric pressure. The control assembly 152 is structured to, and does, actuate the fluid system negative pressure generator 154 and the fluid system positive pressure generator 156 in an overlapping manner. As used herein, an "overlapping manner" means that both the fluid system negative pressure generator 154 and the fluid system positive pressure generator 156 are generating a pressure at the same time and for more than a small instant. In an exemplary embodiment, the fluid system negative pressure generator 154 is actuated before the fluid system positive pressure generator 156. Thus, the can 2 is held by a vacuum to the mandrel assembly 50 before the can is inflated. Further, the fuel system positive pressure generator 156 is, in an exemplary embodiment, maintained in an actuated state for longer than the fluid system negative pressure generator 154 so that the can 2 is ejected from the mandrel assembly 50.

In an exemplary embodiment, the fluid system negative pressure generator 154 and the fluid system positive pressure generator 156 both generate a pressure for about the time a can 1 is disposed on the mandrel assembly 50.

Each fluid system vacuum conduit 158 is in fluid communication with the fluid system negative pressure generator 154 and with the mandrel shaft body vacuum conduit 70. As such, each mandrel shaft body vacuum conduit 70 is, as used herein, part of a fluid system vacuum conduit 158. Each fluid system vacuum coupling 160 is in fluid communication with a mandrel shaft body vacuum conduit 70. That is, each fluid system vacuum coupling 160 is disposed within an associated mandrel body second end 92. Further, each fluid system vacuum coupling 160 is structured to be coupled to a can 1. That is, in an exemplary embodiment, each fluid system vacuum coupling 160 includes a resilient, partially conical body, such as, but not limited to a suction cup 161. Each fluid system vacuum coupling 160 is structured to engage a can end 4 when the can is disposed on a mandrel 80 and when a negative pressure is drawn via the fluid system negative pressure generator 154. Thus, the fluid system 150 is structured to bias a can against the mandrel 80. Stated alternately, the fluid system 150 is structured to bias a can necked opening 3 against the necked engagement surface 110.

As shown in FIG. 3, a fluid system manifold 164 is disposed about each mandrel body first end 86. Each fluid system manifold 164 is structured to be, and is, in fluid communication with the positive pressure generator 156. Each fluid system manifold 164 is further structured to be, and is, in fluid communication with each mandrel body pressure conduit 120. Thus, each mandrel body pressure conduit 120 is, as used herein, also part of a fluid system pressure conduits 162. In this configuration, the fluid system 150 is structured to provide fluid at a positive pressure each pressure conduit outlet 124.

Thus, in operation, a can 1 is disposed on a mandrel 80 as described above. It is further noted that, in the configuration disclosed above, when the can 1 is disposed on a mandrel 80 there is a space, or plenum 180, between the mandrel body outer surface cylindrical portion 102 (as well as some portions of the mandrel body outer surface conical portion 100) and the inner surface of the can 1. Further, each pressure conduit outlet 124 is in fluid communication with the plenum 180.

In an exemplary embodiment, when the fluid system negative pressure generator 154 and the fluid system positive pressure generator 156 are actuated in an overlapping manner, with the fluid system negative pressure generator 154 actuated before the fluid system positive pressure generator 156. Further, the fluid system negative pressure generator 154 generates a greater bias on the can 1 than the fluid system positive pressure generator 156. In this configuration, the fluid system negative pressure generator 154 draws the can 1 against the mandrel 80 as described above, then the fluid system positive pressure generator 156 applies a positive pressure to the plenum 180. As used herein, a can 1 having a positive pressure applied to the can sidewall 2 is "inflated." Thus, the fluid system positive pressure generator 156 is structured to inflate the can 1. The can 1 is both drawn against the mandrel 80 and inflated during the printing process. After the printing process, the fluid system negative pressure generator 154 and the fluid system positive pressure generator 156 are disengaged. The fluid system positive pressure generator 156 is, in an exemplary embodiment, re-actuated, or maintained in an actuated state longer then the fluid system negative pressure generator 154, so as to eject the can 1 from the mandrel 80.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A mandrel assembly for a can decorator, said mandrel assembly comprising:

a mandrel shaft assembly including an elongated body, said mandrel shaft body including an outer surface, a proximal, first end and a distal, second end;

wherein said mandrel shaft outer surface is generally cylindrical;

a mandrel including a hollow, elongated mandrel body including an outer surface, a proximal, first end, a proximal medial portion, a distal medial portion, and a distal, second end and having an axis of rotation;

said mandrel body defining an enclosed space;

said mandrel body outer surface including an elongated conical portion, said mandrel body outer surface conical portion disposed adjacently about said mandrel body proximal, first end;

said mandrel body coupled to said mandrel shaft assembly with said mandrel shaft assembly body partially disposed in said mandrel body enclosed space;

said mandrel shaft assembly includes a fluid system;

said mandrel body distal, second end is generally toroidal;

said fluid system including a vacuum conduit and a vacuum coupling;

said fluid system vacuum conduit coupled to, and in fluid communication with, said fluid system vacuum coupling;

said fluid system vacuum coupling disposed within an associated mandrel body distal, second end;

said fluid system vacuum coupling structured to be coupled to a can;

said mandrel body outer surface includes a non-engagement surface and a number of pressure conduits, each said pressure conduit including an outlet;

each said pressure conduit outlet disposed adjacent said mandrel body outer surface non-engagement surface said fluid system includes a control assembly, negative pressure generator and a positive pressure generator;

said fluid system negative pressure generator is coupled to, and in fluid communication with, said fluid system vacuum conduit;

said fluid system positive pressure generator is coupled to, and in fluid communication with, each said pressure conduit; and said fluid system control assembly structured to actuate said fluid system negative pressure generator and said fluid system positive pressure generator in an overlapping manner.

2. The can decorator of claim 1 wherein each said mandrel body outer surface conical portion is flared.

3. A can decorator comprising:

a mandrel turret;

a number of mandrel assemblies, each mandrel assembly including a mandrel shaft assembly and a mandrel;

each mandrel assembly rotatably coupled to said mandrel turret;

each mandrel shaft assembly including an elongated body, each said mandrel shaft body including an outer surface, a proximal, first end and a distal, second end;

wherein each said mandrel shaft outer surface is generally cylindrical;

each mandrel including a hollow, elongated mandrel body including an outer surface, a proximal, first end, a proximal medial portion, a distal medial portion, and a distal, second end and having an axis of rotation;

each said mandrel body defining an enclosed space;

each said mandrel body outer surface including an elongated conical portion, each said mandrel body outer surface conical portion disposed adjacently about an associated mandrel body proximal, first end;

each said mandrel body coupled to an associated mandrel shaft assembly with each said mandrel shaft body partially disposed in said associated mandrel body enclosed space;

wherein each said mandrel body outer surface conical portion defines a necked engagement surface;

said mandrel assembly includes a fluid system;

each said mandrel body second end is generally toroidal;

said fluid system including a vacuum conduit and a vacuum coupling;

said fluid system vacuum conduit coupled to, and in fluid communication with, said fluid system vacuum coupling;

said fluid system vacuum coupling disposed within said mandrel body distal, second end;

said fluid system vacuum coupling structured to be coupled to a can;

said mandrel body outer surface includes a non-engagement surface and a number of pressure conduits, each said pressure conduit including an outlet;

each said pressure conduit outlet disposed adjacent said mandrel body outer surface non-engagement surface;

said fluid system includes a control assembly, negative pressure generator and a positive pressure generator;

said fluid system negative pressure generator is coupled to, and in fluid communication with, said fluid system vacuum conduit;

said fluid system positive pressure generator is coupled to, and in fluid communication with, said pressure conduit; and said fluid system control assembly structured to actuate said fluid system negative pressure generator and said fluid system positive pressure generator in an overlapping manner.

* * * * *